United States Patent [19]

Seabrooke

[11] Patent Number: 4,470,161

[45] Date of Patent: Sep. 11, 1984

[54] TOILET SEAT LIFTING DEVICE

[75] Inventor: Allan B. Seabrooke, Bradenton, Fla.

[73] Assignee: Sani-Seat Incorporated, Bradenton, Fla.

[21] Appl. No.: 572,749

[22] Filed: Jan. 23, 1984

Related U.S. Application Data

[63] Continuation-in-part of Ser. No. 410,996, Aug. 24, 1982, Pat. No. 4,426,743.

[51] Int. Cl.[3] ..... A47K 13/10

[52] U.S. Cl. ..... 4/251; 4/661

[58] Field of Search ..... 4/251, 661

[56] References Cited

U.S. PATENT DOCUMENTS

| | | | |
|---|---|---|---|
| 1,308,596 | 7/1919 | Klein | 4/251 |
| 1,792,811 | 2/1931 | Bustin | 4/251 |
| 1,863,682 | 6/1932 | Alberts | 4/251 |
| 2,136,684 | 11/1938 | Greavu | 4/251 |
| 2,563,095 | 8/1951 | Bayrodt | 4/251 |
| 2,814,049 | 11/1957 | Mercur | 4/251 |

FOREIGN PATENT DOCUMENTS

| | | | |
|---|---|---|---|
| 612930 | 11/1926 | France | 4/251 |
| 531962 | 8/1955 | Italy | 4/251 |
| 202278 | 10/1908 | Netherlands | 4/251 |

*Primary Examiner*—Henry K. Artis

*Attorney, Agent, or Firm*—Cushman, Darby & Cushman

[57] ABSTRACT

A toilet seat assembly includes a toilet seat mounted at its rear edge for swinging movement about a horizontal axis between a horizontal position and a raised position; and an operator-controlled device for selectively raising and lowering the seat, the device including an operator-actuated member movable between first and second positions a control member movable by the operator-actuated member to apply and remove raising torque to and from the seat in the first and second positions, respectively, and a resilient absorbing device connected to the control member for permitting movement of the control member upon forcible lowering of the seat when the control member is in its first position.

1 Claim, 4 Drawing Figures

TOILET SEAT LIFTING DEVICE

This application is a continuation-in-part of application Ser. No. 410,996 filed Aug. 24, 1982, now U.S. Pat. No. 4,426,743.

This invention relates to a toilet seat control mechanism for raising and lowering a toilet seat, particularly a foot-operated mechanism.

BACKGROUND

Devices for controlling the raising and/or lowering of toilet seats and/or seat covers, including foot-operated devices are disclosed in a number of prior patents and publications.

The following prior art is of record in the file of the patentee's prior U.S. Pat. No. 4,426,743 of which this application is a continuation-in-part:

U.S. Pat. Nos. 428,001, 1,308,596, 1,792,811, 1,863,682, 1,999,971, 2,814,049 and 4,150,446

Norwegian Pat. No. 16,354 (cited in U.S. Pat. No. 4,150,446)

French Pat. No. 612,930

Italian Pat. No. 531,962

SUMMARY OF THE INVENTION

The control device of the present invention is a modification of the system illustrated in the patentee's prior U.S. Pat. No. 4,426,743, the disclosure of which is incorporated herein by reference. Both control devices include an arrangement in which the seat, hinged at its rear edge as is conventional, has applied to it a resilient torque in a seat-raising direction, the weight of the seat being sufficient to overcome the raising torque so that the seat normally assumes a horizontal down position. Both arrangements also provide a means such as a foot-operated pedal and control assembly for applying additional resilient raising torque sufficient to swing the seat upwardly to a raised position of something less than vertical. A principal feature of both arrangements is that, when the seat is being so held in a raised position, a downward force manually applied to the seat either accidentally or intentionally in a direction to swing the seat toward a horizontal, closed position is resiliently absorbed rather than being applied to breakable or damageable parts of the mechanism.

In the modified system the means for applying resilient torque to the seat is located differently than illustrated in the patentee's prior patent, although the overall operation of the two systems employs the same general principles. The patent discloses a system in which the seat is mounted for free swinging movement about a shaft which is mounted for rotation about its longitudinal axis, with a helical spring loosely surrounding the shaft. One end of the spring is connected to the shaft for rotation therewith and the other end of the spring applies an upward resilient torque to the seat. The means for increasing the upward torque includes a foot-operated pedal and a control member such as a cable connected between the pedal and the shaft in a manner that the pulling force applied to the cable by depressing the pedal causes rotation of the shaft in a direction to wind the spring thereby swinging the seat upwardly. Forcible lowering of the seat while the foot pedal is still depressed results in further winding of the spring, not in damage to any of the parts. That is, the spring absorbs the force generated by such forcible lowering.

In the modified system the means for absorbing the force generated by forcible lowering of the seat is associated with the cable. The force-absorbing means preferably is a spring connected to the cable to permit or accommodate such cable movement as results from forcible downward movement of the seat, without requiring movement of the other parts of the system. In one practical embodiment the force-absorbing spring is separate from a spring which provides the necessary seat-raising torque. In such an embodiment the torque-producing spring can be arranged to apply the necessary torque to the foot pedal and the force absorbing-spring can be connected between the lower end of the cable and the foot pedal. In the illustated embodiment the two springs are compression springs. It is contemplated that by suitable rearrangement one or both of the springs can be tension springs. It is also contemplated that the separate torque-producing spring can be omitted, in which case the strength and stroke of the other spring is selected such that this spring takes over the torque-producing function of the omitted spring and has a sufficient stroke to absorb the cable movement resulting from forcible lowering of the seat against the torque of the spring.

Figure 2:
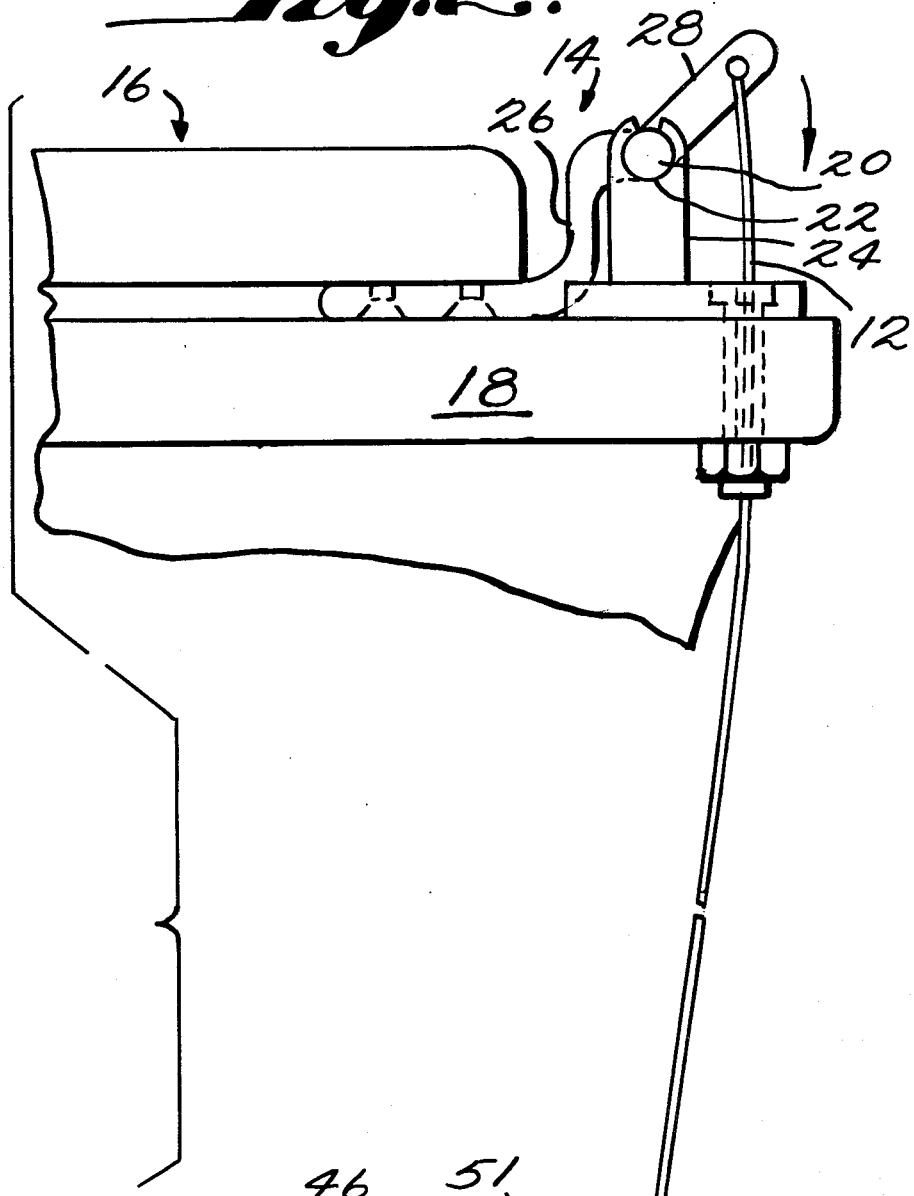
FIG. 2 is a schematic side elevational view of a toilet seat operable by the mechanism of FIG. 1.
Figure 1:
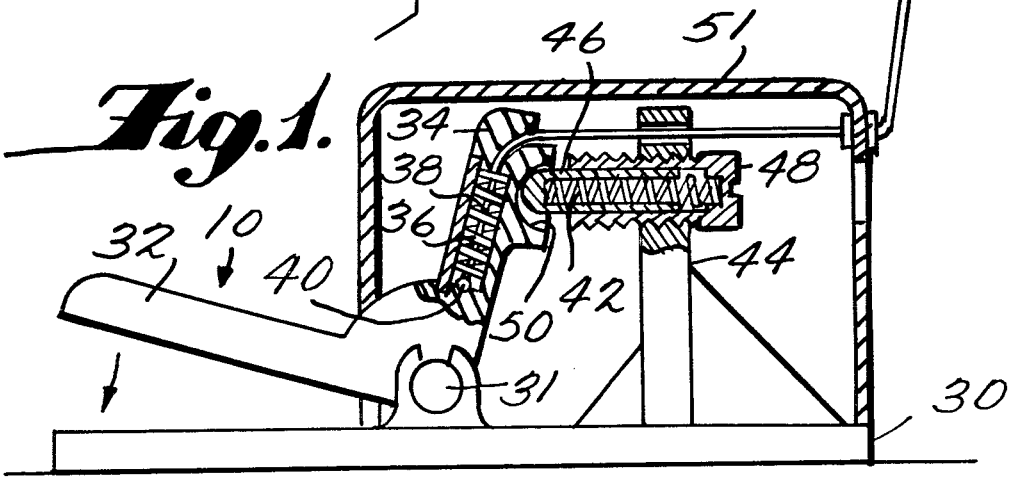
FIG. 1 is a schematic side elevational view of a foot-pedal mechanism for applying a raising force to a toilet seat.

The toilet seat control system of FIGS. 1 and 2 includes a foot-operated pedal 10 in the form of an L-shaped lever and a control member in the form of a cable 12 connected between the pedal 10 and a toilet seat assembly 14. The latter includes a toilet seat 16 mounted on top of a toilet bowl 18 for swinging movement about a horizontal axis 20. In the illustrated embodiment the axis 20 is defined by a shaft 22 which is mounted for rotation in brackets, one of which is shown at 24, attached to the toilet bowl 18. Hinge pieces, one of which is shown at 26, are fixed at one end to the rear edge portion of the seat 16 and at the other end to the shaft 22. A control lever 28 is fixed to the hinge piece 26 or to the shaft 22. The hinge piece 26, shaft 22 and control lever 28 can be cast as a single integral unit. The end of the control cable 12 opposite the end which is connected to the foot pedal 10 is connected to the lever 28, with the result that the pulling force exerted on the cable 12 by counter clockwise rotation of the foot pedal 10 is applied to the lever 28, pulling the latter downwardly (clockwise) thus rotating the shaft 22 clockwise and causing the seat 16 to swing upwardly.

The foot pedal assembly includes a floor-supported base 30 to which the foot pedal 10 is pivoted for rotation about a horizontal axis 31. One leg 32 of the pedal is adapted to be depressed by an operator's foot. The other leg 34, which serves as a crank arm, is adapted to apply a pulling force on the control cable 12. The adjacent end of the cable 12 is not fixed to the leg 34 but rather receives the pulling force through a force-absorbing spring 36 in the form of a helical compression spring which resides in a recess 38 in the leg 34. The cable 12 passes downwardly through the spring 36, with the respective end of the cable 12 carrying an enlarged element such as a ball 40 or plate which bears against the lower end of the spring 36. The upper end of the spring 36 bears against the upper wall of the recess 38.

The foot pedal 10 is biased in a counter clockwise direction by a torque-producing spring in the form of a helical compression spring 42 which is mounted in a bracket 44 attached to the base 30. The spring 42 is located in a recess formed between a slidable hollow plunger 46 and a sleeve 48. The exterior of the sleeve 48 is threaded and engages matting threads in a bore in the bracket 44 to permit the longitudinal position of the sleeve 48 relative to the bracket 44 to be adjusted. One end of the spring 42 rests against the plunger 46 and the other end rests against the sleeve 48 so that the plunger 46 is biased to the left. The left end of the plunger 46 engages in a socket 50 in the leg 34 of the foot pedal 10 thereby biasing the foot pedal 10 in a counter clockwise direction. A cover 51 overlies the spring assemblies and is removably attached to the base 30.

The weight of the seat 16 effects tension in the control cable 12 and this tension, acting through the compression spring 36, tends to swing the foot pedal counter clockwise. This tendency is resisted by the compression spring 42, the biasing force of which is adjustable by rotation of the sleeve 48. The normal at-rest position of the system is shown in FIGS. 1 and 2, the net forces on the foot pedal 10 permitting the seat 16 to assume a horizontal position. That is, these net forces on the pedal 10 result in a resilient bias force on the seat in a direction to raise the seat but the weight of the seat 16 overcomes the bias force. Only a small additional raising force is required to cause the seat 16 to swing upwardly, and this additional force is easily applied by depressing the foot pedal. Some compression of the spring 36 between the ball 40 and the upper end of the recess 38 may occur during foot pedal depression but the spring 36 is sufficiently stiff to transmit additional force to the cable 12 resulting in addition torque on the lever 28 in a clockwise direction. Typically the spring 36 is quite stiff, and in both the seat-up and seat-down positions this spring may be essentially uncompressed. Under these conditions the spring 42 effects all or essentially all of the biasing force on the seat 16. Typically, also, the compression in the spring 42 will become reduced to such an extent that when the seat 16 reaches its raised position the spring 42 applies essentially no counter clockwise force to the foot pedal 10. It is contemplated, however, that both springs 42 and 36 can be compressed at all times.

Overall operation of the system is as follows. With the foot pedal 10 in its normal up position the seat 16 will be in its horizontal or down position. As described above, these positions are achieved as a result of the bias force in the torque-producing spirng 42 being insufficient to produce an upward (clockwise) torque on the seat 16 exceeding the downward (counter clockwise) torque on the seat 16 resulting from the weight of the seat 16. When the foot pedal 10 is depressed the resulting pulling force on the cable 12, acting through the force-absorbing spring 36 (which is stiff enough to transmit the force without significant compression), produces an additional clockwise torque on the crank lever 28 thereby causing the lever 28, shaft 22, hinge 26 and seat 16 to rotate clockwise. When the foot pedal is released, downward torque resulting from the weight of the seat 16 overcomes the force of the spring 42 so that the seat 16 swings down to its horizontal position. For this to occur, the seat 16 must not have been raised to an over-center position, because in such position the weight of the seat 16 would not produce counter clockwise torque. Typically a stop (not shown) is provided to prevent the seat 16 from swinging upwardly more than about 70° from the horizontal position.

The force-absorbing spring 36 prevents damage to the system in the event that the seat 16 is forcibly lowered while the foot pedal remains depressed by an operator's foot. Such forcible lowering would not be a normal movement of the seat but might result, for example, from the operator's unfamiliarity with the equipment or from attempted vandalism. Whatever the cause of the forcible lowering of the seat, the resulting movement of the cable 12 is accommodated by the spring 36 which beomces compressed by the upward force applied to its lower end.

Figure 3:
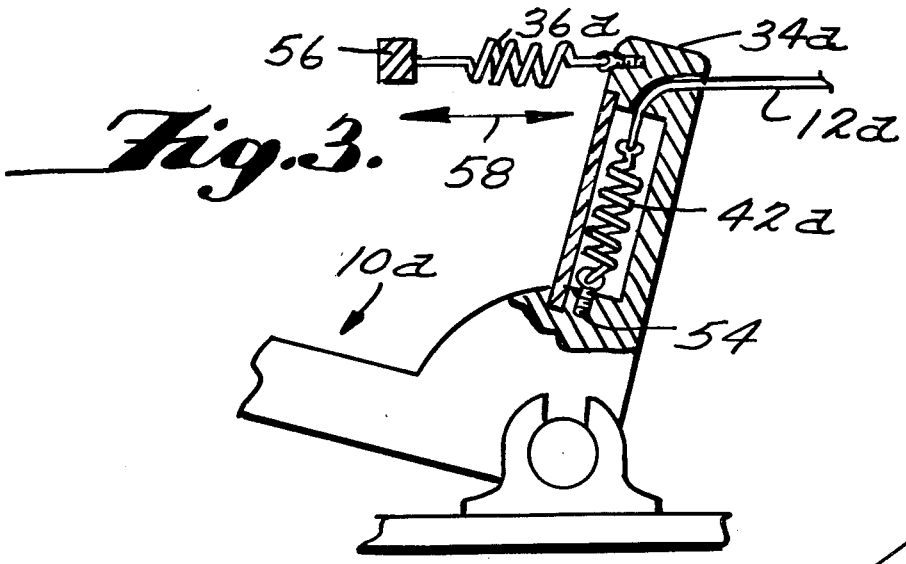
FIG. 3 is a fragmentary view illustrating a second embodiment of spring arrangement.

FIG. 3 illustrates an embodiment in which a foot pedal **10*a* is acted on by a torque-producing spring 42*a* and a force-absorbing spring 36*a*, both of which are tension springs. The lower end of the spring 42*a* is fixed to the foot pedal 10*a* at 54 and its upper end is attached to the cable 12*a*. The spring 36*a* is connected between the foot pedal leg 34*a* and an adjustment member 56 which is adjustable toward and away from the leg 34 in the directions of the arrow 58 in order to permit adjustment of the tension in the spring 36*a*. The cable 12*a* is assumed to be connected to a seat assembly as shown in FIG. 2. In the at-rest position of the parts the seat will be in its down position, with an upward torque applied thereto by the spring 36*a* via the foot pedal leg 34*a*, the spring 42*a* and the cable 12*a*. Typically, the spring 42*a* will be quite stiff and will transmit the force without significant elongation. When the foot pedal 10*a* is depressed, additional tension is applied to the cable 12*a*, sufficient to cause the seat to rise. Again there is no significant elongation of the spring 42*a*. If the seat is forcibly lowered while the foot pedal is depressed, the resulting movement of the cable 12*a* will be absorbed by stretching of the spring 42*a***.

Figure 4:
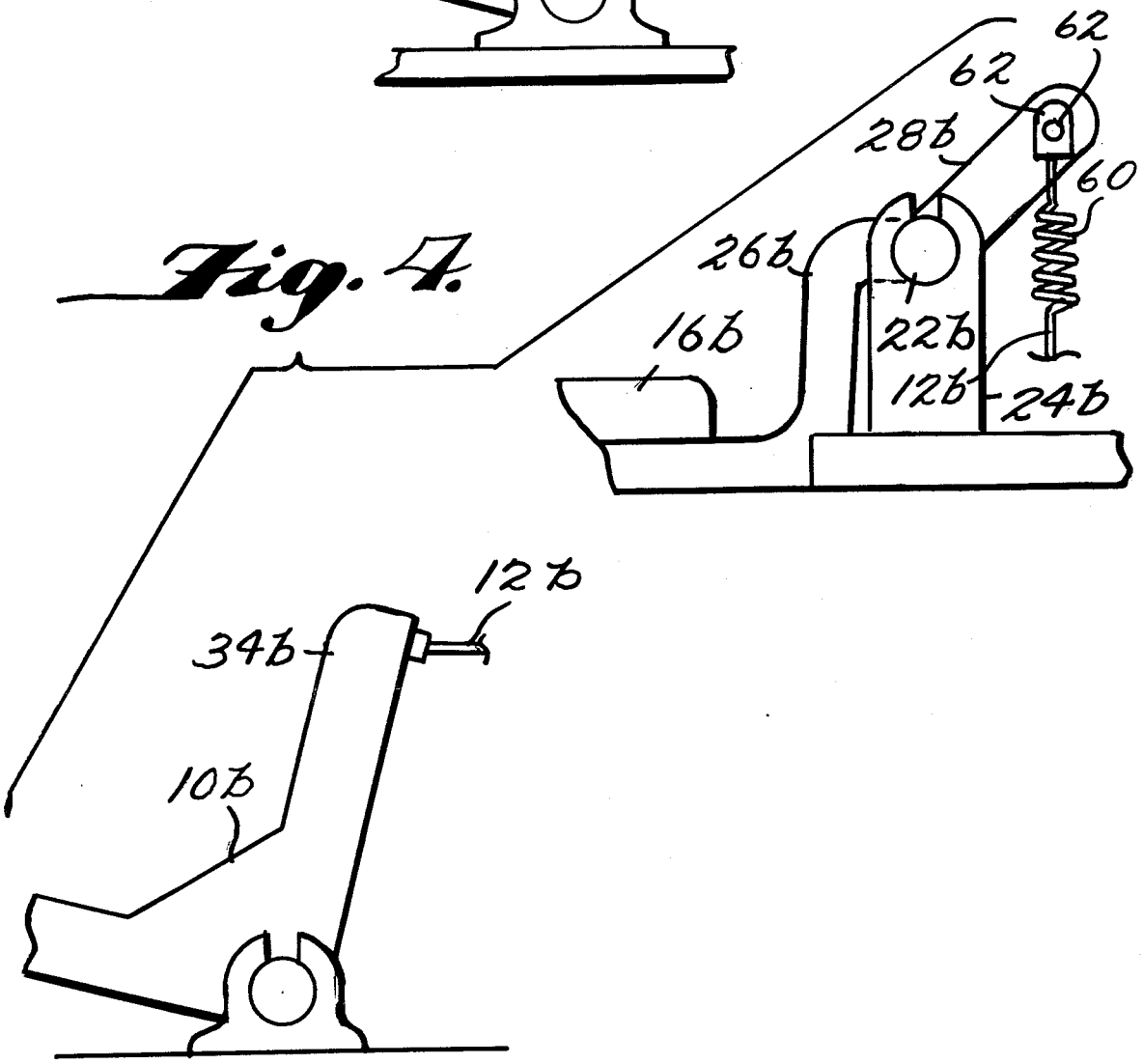
FIG. 4 is a fragmentary view illustrating a third embodiment of spring arrangement.

FIG. 4 illustrates a single-spring embodiment in which a tension spring 60 is connected between one end of a control cable **12*b* and the lever 28*b* of a seat assembly 14*b* which is structurally the same as in FIG. 2. The other end of the cable 12*b* is connected to the leg 34*b* of the foot pedal 10*b*. Tension in the spring 60 can be adjusted by adjusting the position of a plate 62 to which the other end of the spring 60 is attached, the plate being secured to the lever 28*b* by a bolt 64 which is slidable in a slot (not shown) in the lever 28*b*. In the at-rest position of the parts the seat will be in the down position, with an upward torque applied thereto by the spring 60 which also maintains the cable 12*b* in tension. When the pedal 10*b* is depressed, additional tension is applied to the cable 12*b* which, via the spring 60, effects sufficient torque on the lever 28*b* to cause the lever 28*b*, shaft 22*b*, hinge 26*b* and seat 16*b* to swing counter clockwise. If the seat 16*b* is forcibly lowered while the pedal 10*b* is depressed, the resulting movement of the cable 12*b* will be absorbed by stretching of the spring 60**.

What is claimed is:

1. A toilet seat assembly comprising a toilet seat mounted at its rear edge for swinging movement about a horizontal axis between a horizontal position and a raised position; and operator-controlled means for selectively raising and lowering said seat, said means including an operator-actuated member movable between first and second positions, a control member movable by the operator-actuated member to apply and remove raising torque to and from said seat in said first and second positions, respectively, and resilient absorbing means connected to said control member for permitting movement of said control member upon forcible lowering of said seat when said control member is in its first position.

* * * * *